US006808245B2

(12) United States Patent
Katayama

(10) Patent No.: US 6,808,245 B2
(45) Date of Patent: Oct. 26, 2004

(54) CARTRIDGE AND CARTRIDGE DETECTING DEVICE

(75) Inventor: Naoki Katayama, Kariya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/782,967

(22) Filed: Feb. 23, 2004

(65) Prior Publication Data

US 2004/0179056 A1 Sep. 16, 2004

(30) Foreign Application Priority Data

Mar. 11, 2003 (JP) ..... 2003-065405

(51) Int. Cl.[7] ..... B41J 29/393; B41J 2/175
(52) U.S. Cl. ..... 347/19; 347/86
(58) Field of Search ..... 347/14, 19, 85, 347/86

(56) References Cited

U.S. PATENT DOCUMENTS 6,547,363 B1 * 4/2003 Shinada et al. ..... 347/19

FOREIGN PATENT DOCUMENTS

JP A 11-58773 3/1999 ..... B41J/2/175

JP A 11-91134 4/1999 ..... B41J/2/175

* cited by examiner

*Primary Examiner*—Stephen D. Meier
*Assistant Examiner*—Alfred Dudding
(74) *Attorney, Agent, or Firm*—Oliff & Berridge PLC

(57) ABSTRACT

A cartridge removably installed on a working device and having (a) a passage which is formed so as to extend in a direction of movement of the cartridge for installation thereof on the working device and which has an open end open at one end of the cartridge, and (b) a non-reversibly changing member disposed in the passage, at a suitable distance from the open end, and changeable from a first state for a first relationship with the projecting member, to a second state for a second relationship with the projecting member, the non-reversibly changing member being unable to change from the second state back to the first state. The state of this cartridge may be detected by a cartridge detecting device including a projecting member insertable into the passage through the opening as the cartridge is moved for installation, the projecting member being movable in the direction of movement of the cartridge, a first detector operable by the cartridge when the cartridge is moved for installation, a second detector operable by the projecting member, depending upon whether the non-reversibly changing member is placed in the first or second state, during the movement of the cartridge, and a determining portion operable to determine the state of the cartridge on the basis of outputs of the first and second detectors.

24 Claims, 9 Drawing Sheets

A B C D E F G H
FIRST SENSOR 51
HIGH
LOW
SECOND SENSOR 52
HIGH
LOW
2
64
55
54
53
63
52
65
56b
56a
51
211
212
213

A B C D E F G H
FIRST SENSOR 51
HIGH
LOW
SECOND SENSOR 52
HIGH
LOW
2
64
55
54
53
63
52
65
56b
56a
51

A B C D E F G H
FIRST SENSOR 51
HIGH
LOW
SECOND SENSOR 52
HIGH
LOW
2
64
55
60
54
53
63
52
65
56b
56a
51

CARTRIDGE AND CARTRIDGE DETECTING DEVICE

The present application is based on Japanese Patent Application No. 2003-065405 filed Mar. 11, 2003, the contents of which are incorporated herein by reference.

BACKGROUND OF THE INVENTION

1. Field of the Invention

The present invention relates in general to a cartridge, and a cartridge detecting device, and more particularly to a cartridge a state of which is accurately detectable and which is constructed to prevent the user from interfering with an indicator member indicating the state, and a device constructed to permit accurate detection of the state of the cartridge, while preventing the user's interference with the indicator member.

2. Discussion of Related Art

JP-11-58773A (laid-open publication of Japanese Patent Application) shows, in FIG. 1, in particular, an ink jet recording apparatus capable of determining whether an ink cartridge installed in the apparatus is a new one or a used one. This ink jet recording apparatus is provided with a first switch for detecting whether the ink cartridge per se has been installed in position, and a second switch for detecting whether a film affixed or bonded to the outer surface of a main body of the ink cartridge has been torn or pierced with a needle. The film is arranged to be necessarily torn when the ink cartridge has been installed in position. The ink jet recording apparatus of this type determines that the ink cartridge the installation of which has been detected by the first switch is a new one if the tearing of the film has been detected by the second switch, and a used one if the tearing has not been detected by the second switch. JP-11-58773A also discloses means usable in place of the film, for determining whether the ink cartridge is a new or used one. This means includes a jaw that is arranged to deform when the ink cartridge is installed. The determination as to whether the ink cartridge is the new or used one is based on an amount or state of deformation of the jaw. JP-11-91134 (laid-open publication of Japanese Patent Application) discloses, in FIGS. 1, 4, 6 and 8, in particular, other means for making the determination, such as: means for making the determination depending upon whether an electrically resistive body has been broken; means for making the determination depending upon whether an optical path formed by a photoelectric switch is closed or open; and means for making the determination by reading data stored on a magnetic tape.

Where the film is affixed to the outer surface of the ink cartridge, the user may tear off the film by error prior to the installation of the ink cartridge, or may affix an adhesive tape of a different material to the ink cartridge after the original film has been torn off, or to mend the torn film. In this event, the ink cartridge cannot be used, or the state of installation of the ink cartridge cannot be exactly detected.

Further, the ink jet recording apparatus constructed as described above permits only the determination as to whether the ink cartridge is a new one or a used one.

SUMMARY OF THE INVENTION

It is therefore a first object of the present invention to provide a cartridge detecting device constructed to permit accurate detection of a state of a cartridge while preventing the user from interfering with an indicator member indicating the state of the cartridge. A second object of this invention is to provide a cartridge a state of which is accurately detectable and which is constructed to prevent the user's interference with the indicator member The first object indicated above may be achieved according to a first aspect of this invention, which provides a cartridge detecting device for detecting a state of a cartridge to be removably installed on a working device, the cartridge detecting device comprising: (a) a passage formed within the cartridge and extending in a direction of movement of the cartridge for installation thereof on the working device, the passage having an opening open at one end of the cartridge in the direction of movement; (b) a projecting member insertable into the passage through the opening as the cartridge is moved for installation thereof on the working device, the projecting member being movable in the direction of movement; (c) a non-reversibly changing member disposed in the passage, at a predetermined distance from the opening, the non-reversibly changing member being changeable from a first state for a first relationship with the projecting member, to a second state for a second relationship with the projecting member, the non-reversibly changing member being unable to change from the second state back to the first state; (d) a first detector operable by the cartridge when the cartridge is moved for installation thereof on the working device; (e) a second detector operable by the projecting member, depending upon whether the non-reversibly changing member is placed in the first state or the second state, during the movement of the cartridge for installation thereof on the working device; and (f) a determining portion connected to the first and second detectors and determining the state of the cartridge on the basis of outputs of the first and second detectors.

In the cartridge detecting device constructed according to the first aspect of this invention, the non-reversible changing member is disposed at a portion of the passage, which is spaced a predetermined distance from the opening. The determining portion is arranged to determine the state of the cartridge on the basis of the output of the first detector which is operable by the cartridge during its movement for installation on the working device, and the output of the second detector which is operable by the projecting member during the movement of the cartridge for installation on the working device. In this arrangement, the non-reversibly changing member is not accessible by the user of the cartridge. Accordingly, the present cartridge detecting device assures improved accuracy of detection of the installation of the cartridge on the working device, and improved accuracy of determination of the state of the cartridge, for example, determination as to whether the installed cartridge is a new one or a used one.

According to a first preferred form of the first aspect of this invention, the non-reversibly changing member inhibits a relative movement of the cartridge and the projecting member when the non-reversibly changing member is placed in the first state, and permits the relative movement when the non-reversibly changing member is placed in the second state.

In one advantageous arrangement of the above-indicated first preferred form of the invention, the non-reversibly changing member comprises a generally planar member which inhibits insertion of a distal end portion of the projecting member into an inner portion of the passage located inwardly of the non-reversibly changing member within the cartridge, when the generally planar member is placed in the first state, and which permits the insertion of the distal end portion of the projecting member into the inner portion of the passage, when the generally planar member is placed in the second state.

According to a second preferred form of the first aspect of the invention, the cartridge and the first detector are arranged such that the output of the first detector changes a plurality of times as the cartridge is moved for installation thereof on the working device, and the determining portion is operable to determine the state of the cartridge on the basis of a plurality of combinations of the outputs of the first and second detectors.

In one advantageous arrangement of the above-indicated second preferred form of the cartridge detecting device, the determining portion is operable to determine a state of the non-reversibly changing member on the basis of the output of the first detector generated when the cartridge is located at a predetermined position relative to the working device during the movement for installation thereof, and the output of the second detector which is generated in response to a position of the projecting member relative to the working device.

According to a third preferred form of the first aspect of the invention, the first detector is fixed to the working device, and the cartridge has a plurality of portions (211, 212, 213) which are spaced from each other in the direction of movement and which are positioned relative to the first detector, so as to be engageable with the first detector during its movement, for thereby changing the output of the first detector.

According to a fourth preferred form of the first aspect of the invention, the determining portion is operable to determine that the cartridge is abnormal, on the basis of the output of the second detector generated when the second detector is operated by the projecting member, while the output of the first detector indicates that the non-reversibly changing member has not reached the projecting member.

According to a fifth preferred form of the first aspect of the invention, the determining portion is operable, after the output of the first detector has changed before the non-reversibly changing member reaches the projecting member during the movement of the cartridge for installation thereof on the working device, to determine whether the non-reversibly changing member is placed in the first state or the second state, on the basis of the output of the second detector generated when or after the non-reversibly changing member has reached the projecting member.

According to a fifth preferred form of the first aspect of the invention, the first detector is fixed to the working device, and the cartridge has a portion positioned relative to the first detector during the movement thereof, for thereby changing the output of the first detector, the second detector being fixed to the working device, and the projecting member being movable by the non-reversibly changing member, after the non-reversibly changing member has reached the projecting member, for thereby changing the output of the second detector.

The first object indicated above may also be achieved according to a second aspect of the present invention, which provides a cartridge detecting device for detecting a state of a cartridge to be removably installed on a working device, the cartridge detecting device comprising: (a) a passage formed within the cartridge and extending in a direction of movement of the cartridge for installation thereof on the working device, the passage having an opening open at one end of the cartridge in the direction of movement; (b) a projecting member insertable into the passage through the opening as the cartridge is moved for installation thereof on the working device, the projecting member being movable in the direction of movement; (c) a non-reversibly changing member disposed in the passage, at a predetermined distance from the opening, the non-reversibly changing member being changeable from a first state to a second state, the non-reversibly changing member being unable to change from the second state back to the first state; (d) a detector device operable depending upon whether the non-reversibly changing member is placed in the first state or the second state, when the cartridge is moved for installation thereof on the working device; and (e) a determining portion operable to determine the state of the cartridge on the basis of an output of the detector device. This cartridge detecting device according to the second aspect of this invention has substantially the same advantage as described with respect to the first aspect of the invention.

According to another preferred form of the cartridge detecting device according to the first or second aspect of this invention, the non-reversibly changing member is placed in the first state when a first force acts on the cartridge in the direction of movement thereof for installation thereof on the working device, the non-reversibly changing member in the first state engaging the projecting member so as to inhibit insertion of a distal end portion of the projecting member into an inner portion of the passage located inwardly of the non-reversibly changing member within the cartridge, and permitting the projecting member to be moved with the cartridge in the direction of movement, the non-reversibly changing member changing from the first state to the second state when a second force larger than the first force acts between the projecting member and the non-reversibly changing member, the non-reversibly changing member in the second state permitting the insertion of the distal end portion of the projecting member into the inner portion of the passage.

In one advantageous arrangement of the preferred form of the invention described just above, the cartridge detecting device further comprises a stop member for stopping a movement of the projecting member together with the cartridge in the direction of movement of the cartridge while the non-reversibly changing member is held in engagement with the projecting member in the first state of the non-reversibly changing member, the stop member stopping the movement of the projecting member before the cartridge has been installed at a predetermined position of installation on the working device, the non-reversibly changing member changing from the first state to the second state when the cartridge is further moved in the direction of movement for installation thereof from a position at which the movement of the projecting member is stopped by the stop member.

According to a further preferred form of the cartridge detecting device according to the first or second aspect of this invention, the cartridge is an ink cartridge having an ink reservoir, and the opening of the ink cartridge is communicated with an upper part of the ink reservoir, for introducing an atmosphere into the upper part when the non-reversibly changing member changes from the first state to the second state.

The second object indicated above may also be achieved according to a third aspect of the present invention, which provides a cartridge to be removably installed on a working device, the cartridge comprising: a passage formed extending in a direction of movement of the cartridge for installation thereof on the working device, the passage having an opening open at one end of the cartridge in the direction of movement; and a non-reversibly changing member disposed in the passage, at a predetermined distance from the opening, the non-reversibly changing member being changeable from a first state for a first relationship with the projecting member, to a second state for a second relationship with the projecting member, the non-reversibly changing member being unable to change from the second state back to the first state.

The cartridge may be an ink cartridge having an ink reservoir. In this case, the opening may be communicated with an upper part of the ink reservoir, for introducing an atmosphere into the upper part when the non-reversibly changing member changes from the first state to the second state.

BRIEF DESCRIPTION OF THE DRAWINGS

The above and other objects, features, advantages and technical and industrial significance of the present invention will be better understood by reading the following detailed description of preferred embodiments of the invention, when considered in connection with the accompanying drawings, in which.

DETAILED DESCRIPTION OF THE PREFERRED EMBODIMENTS

Figure 1:
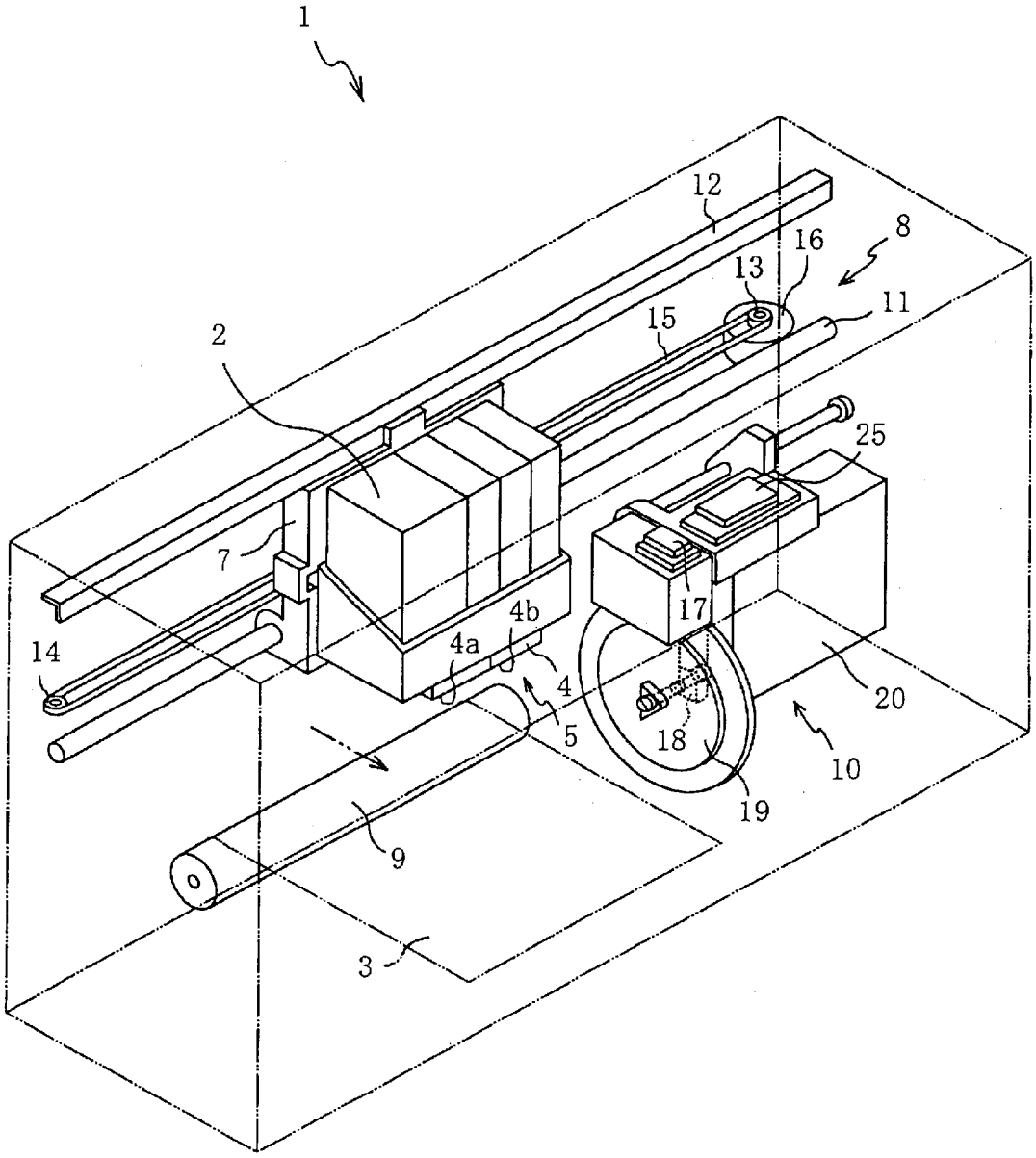
FIG. 1 is a perspective view schematically showing an internal arrangement of a color ink-jet printer equipped with ink cartridges constructed according to one embodiment of this invention.

Referring first to the perspective view of FIG. 1, there is shown an ink jet recording apparatus in the form of a color ink-jet printer 1 constructed according to the first embodiment of this invention. As shown in FIG. 1, the color ink-jet printer 1 includes: four ink cartridges 2 filled with respective cyan, magenta, yellow and black inks; a head unit 5 having working devices in the form of four ink-jet heads 4 which are arranged to eject droplets of the inks of the respective four colors, for performing a printing operation on a sheet of paper 3; a carriage 7 which carries the ink cartridges 2 and the head unit 5; a drive unit 8 operable to reciprocate the carriage 7 along a straight line; a platen roller 9 extending in the direction of reciprocation of the carriage 7 and positioned in an opposed relationship with the ink jet heads 4; and a purging device 10

The drive unit 8 includes: a carriage shaft 11 extending in parallel with the platen roller 9 and slidably engaging a lower end portion of the carriage 7; a guide plate 12 extending in parallel with the carriage shaft 11 and slidably engaging an upper end portion of the carriage 7; two pulleys 13 and 14 disposed between the carriage shaft 11 and the guide plate 12 and located at the respective opposite ends of the carriage shaft 11; and an endless belt 15 which connects the two pulleys 13, 14 and to which the carriage 7 is fixed.

When the pulley 13 is rotated in opposite directions by an operation of an electric motor (CR motor) 16, the carriage 7 is reciprocated through the endless belt 15 fixed thereto, while being slidably supported and guided by the carriage shaft 11 and the guide plate 12.

Figure 2:
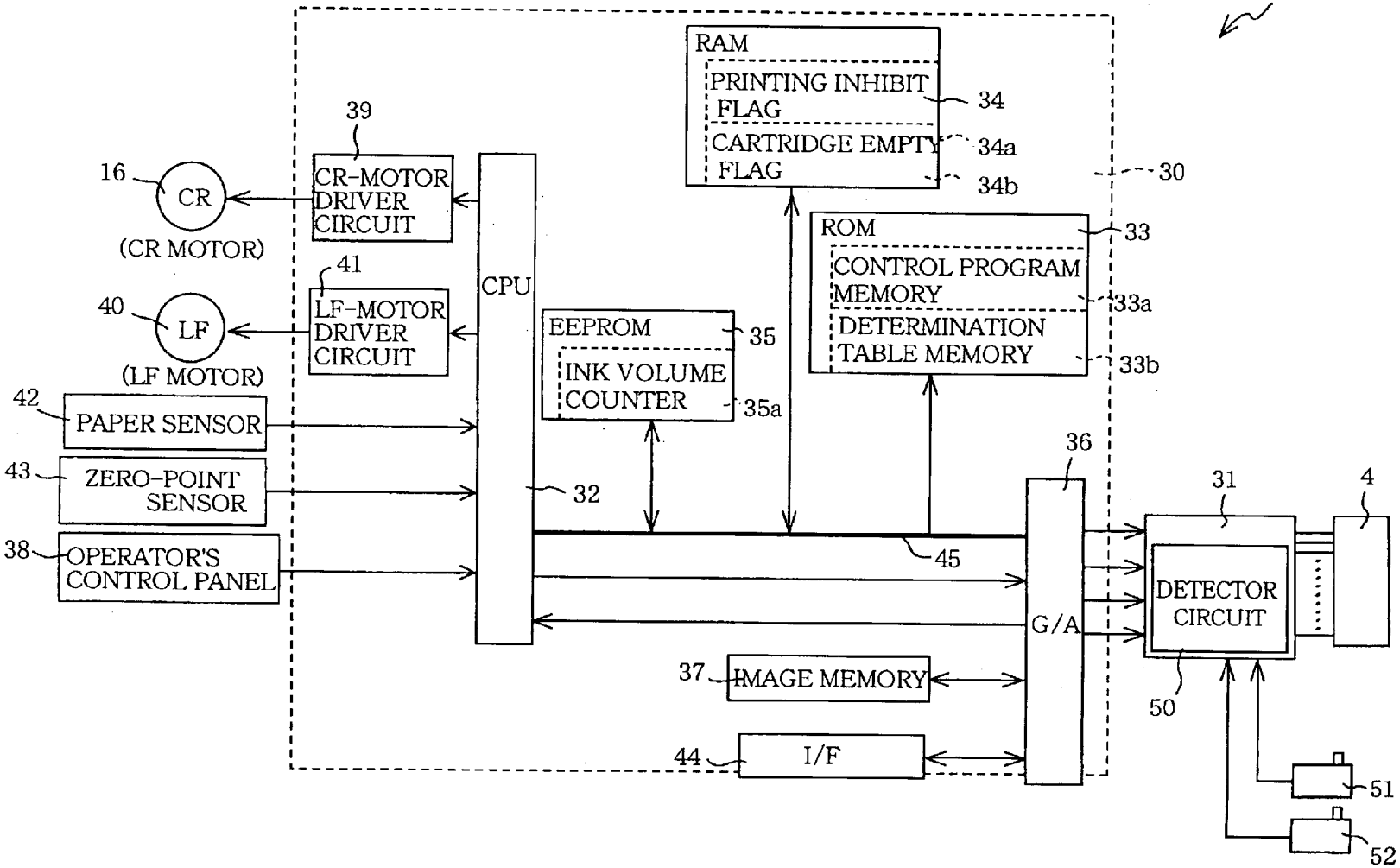
FIG. 2 is a block diagram illustrating an electric circuit arrangement of the color ink-jet printer.

As shown in FIG. 2, the color ink-jet printer 1 further includes an electric motor (LF motor) 40 operable to deliver the paper sheet 3 from a paper sheet cassette (not shown), which is disposed on one side of the printer 1. The paper sheet 3 is fed along a path which extends through a gap between ink ejecting surfaces 4*a*, 4*b* of the ink-jet heads 4 and the outer circumferential surface of the platen roller 9. A printing operation is performed on the paper sheet 3, with ejection of droplets of the inks from a plurality of nozzles formed in each of the ink ejecting surfaces 4*a*, 4*b*. After the printing operation, the paper sheet 3 with a printed image is ejected onto a paper sheet tray (not shown). A sheet feeding mechanism for feeding the paper sheet 3 and a sheet ejecting mechanism for ejecting the paper sheet 3 are not shown in FIG. 1.

The purging device 10 is located within a reciprocating stroke of the carriage 7 and near one of the opposite axial ends of the platen roller 9, such that the purging device 10 is spaced apart from the above-indicated one end of the platen roller 9 in the axial direction away from the other end. The purging device 10 is arranged to remove poor-quality inks (e.g., inks having an excessively high degree of viscosity) which may close the nozzles of the ink-jet heads 4 and which contain air bubbles and foreign matter. That is, the purging device 10 is provided to restore the ink-jet heads 4 to their normally operable states. The purging device 10 is positioned such that the ink-jet heads 4 are opposed to the purging device 10 when the head unit 5 is located at a predetermined purging position. The purging device 10 includes a purge cap 17, a suction pump 18, a cam 19, and a waste-ink reservoir 20.

The purge cap 17 is a substantially box-like structure open toward the ink ejecting surfaces 4*a*, 4*b* of one of the ink-jet heads 4, and is formed so as to cooperate with the ink ejecting surfaces 4*a*, 4*b* to define a fluid-tight space. The box-like structure has a bottom wall having an outlet (not shown) that is held in communication with the suction pump 18. This suction pump 18 has a piston which is reciprocated by a rotary motion of the cam 19. The purge cap 17 is arranged to be moved toward and away from the ink ejecting surfaces 4*a*, 4*b* when the cam 19 is rotated by the LF motor 40 (FIG. 2).

The waste-ink reservoir 20 is disposed adjacent to the purge cap 17, and has a substantially box-like structure. The waste ink sucked by the suction pump 18 is stored in the waste-ink reservoir 20 through the above-indicated outlet of the purge cap 17. On the upper surface of the waste-ink reservoir 20, there is disposed a cap 25 which is provided for contact with the ink ejecting surfaces 4*a*, 4*b* of the ink-jet heads 4 when the head unit 5 is returned to its predetermined home position after a printing operation. Namely, the cap 25 covers the ink ejecting surfaces 4*a*, 4*b* to prevent evaporation of the inks.

Referring next to the block diagram of FIG. 2, the color ink-jet printer 1 is provided with a control device including a main control board 30 mounted on the main body of the printer, and a carriage board 31 mounted on the carriage 7. The main control board 30 incorporates: a one-chip microcomputer (CPU) 32; a ROM 33 having a control program memory 33*a* storing various control programs executed by the CPU 32 and various fixed data used by the CPU 32; a RAM 34 for temporarily storing various data; an EEPROM 35; an image memory 37; and a gate array 36.

The CPU 32 functioning as an arithmetic and logic device is operable to perform various operations according to the control programs stored in the control program memory 33*a* of the ROM 33. The CPU 32 is further operable to generate a printing timing signal and a resetting signal and apply these signals to the gate array 36. To the CPU 32, there are connected: an operator's control panel 38 through which the user enters desired commands (e.g., print mode command) into the main control board 30; a CR-motor driver circuit 39 for operating the carriage drive motor (CR motor) 16 to reciprocate the carriage 7; a LF-motor driver circuit 41 for operating the sheet feeding motor (LF motor) 40 to feed the paper sheet 3; a paper sensor 42 for detecting a leading edge of the paper sheet 3; and a zero-point sensor 43 for detecting a zero point of the carriage 7. The various elements connected to the CPU 32 are controlled by the CPU 32.

The control programs stored in the control program memory 33*a* of the ROM 33 include an ink-cartridge-state determining control program for executing an ink-cartridge-state determining routine for determining the state of each ink cartridge 2. This routine is illustrated in the flow chart of FIG. 4. The ROM 33 further includes a determination table memory 33*b* which stores data for determining the state of the ink cartridge 2, that is, data indicative of conditions for determining the state of the ink cartridge 2 on the basis of output signals of a first detector in the form of a first sensor 51 and a second detector in the form of a second sensor 52 (which will be described) received by a detector circuit 50, and timings of generation of those output signals, as described below in detail. The first and second sensors 51, 52 cooperate with the detector circuit 50 to constitute a detector device an output of which is fed to the main control board 30.

The RAM 34 is a programmable volatile memory, and stores a PRINTING INHIBIT flag 34*a* and a CARTRIDGE EMPTY flag 34*b*, when appropriate, during execution of the ink-cartridge-state determining routine executed by the CPU 32 according to the ink-cartridge-state determining control program stored in the ROM 33. The PRINTING INHIBIT flag 34*a* is used to inhibit a printing operation when it is determined that the installed ink cartridge 2 is a used one or defective, for example.

The CARTRIDGE EMPTY flag 34*b* indicates whether the volume of the ink left in the ink cartridge 2 is smaller than a predetermined lower limit. This flag 34*b* is turned on when a count of an ink volume counter 35*a* (which will be described) becomes smaller than a predetermined threshold.

The EEPROM 35 is a programmable non-volatile memory, and includes the above-indicated ink volume counter 35*a* for each ink-jet head 4. The ink volume counter 35*a* is provided to measure the volume of the ink left in an ink reservoir 2*a* of the ink cartridge 2. Namely, the ink volume counter 35*a* operates to subtract a sum of an ink volume ejected from the nozzles of the corresponding ink-jet head 4 and an ink volume discharged from the ink-jet head 4 into the waste-ink reservoir 20 of the purging device 10, from the nominal initial volume of the ink in the ink reservoir 2*a*. The four volume counters 35*a* corresponding to the respective four ink-jet heads 4 are updated independently of each other.

When the count of each ink volume counter 35*a* has become smaller than the predetermined threshold value, the CPU 32 determines that the corresponding ink cartridge 2 has become empty. The count of each ink volume counter 35*a* is reset to the initial value when it is determined in the ink-cartridge-state determining routine (described below) that the corresponding ink cartridge 2 installed on the printer 1 is a new one.

The gate array (G/A) 36 is operable according to a printing timing signal received from the CPU 32, and image data stored in the image memory 37, to generate printing data (drive signals) for printing on the paper sheet 3 an image represented by the image data, a clock signal for synchronization with the printing data, a latch signal, a parameter signal for generating a basic printing waveform signal, and an ejection timing signal indicative of a predetermined ink ejection interval. The signals generated by the gate array 36 are fed to the carriage board 31 that incorporates ink-jet head drivers.

The gate array 36 is further operable to store in the image memory 37 the image data received from an external computer or other device through a centronics interface (I/F) 44. The gate array 36 is further operable according to centronics data received from a host computer or other device through the centronics interface 44, to generate an interruption signal for reception of the centronics data. This interruption signal is fed to the CPU 32. The gate array 36 and the carriage board 31 are connected to each other through a harness cable, for transmission of the various signals therebetween. The CPU 32, ROM 33, RAM 34, EEPROM 35 and gate array 36 are connected to each other through a bus line 45.

The ink-jet head drivers (driver circuits) incorporated in the carriage board 31 are operable to drive the respective ink-jet heads 4. The ink-jet head heads 4 are connected to the respective ink-jet head drivers through printed-wiring boards on which copper foil wiring patterns are formed on polyimide films of a thickness of 50–150 $\mu$m. The ink-jet head drivers are controlled by the gate array 36 incorporated in the main control board 30, to apply the drive pulses to actuator elements of the ink-jet heads 4 such that the waveform of the drive pulses corresponds to a selected printing mode, so that the ink droplets of desired volumes are ejected from the ink-jet heads 4.

The carriage board 31 is provided with the above-indicated detector circuit 50, which is connected to the first and second sensors 51, 52 indicated above. The detector circuit 50 is arranged to provide the main control board 30 with signals generated on the basis of the outputs of the first and second sensors 51, 52.

Figure 3A:
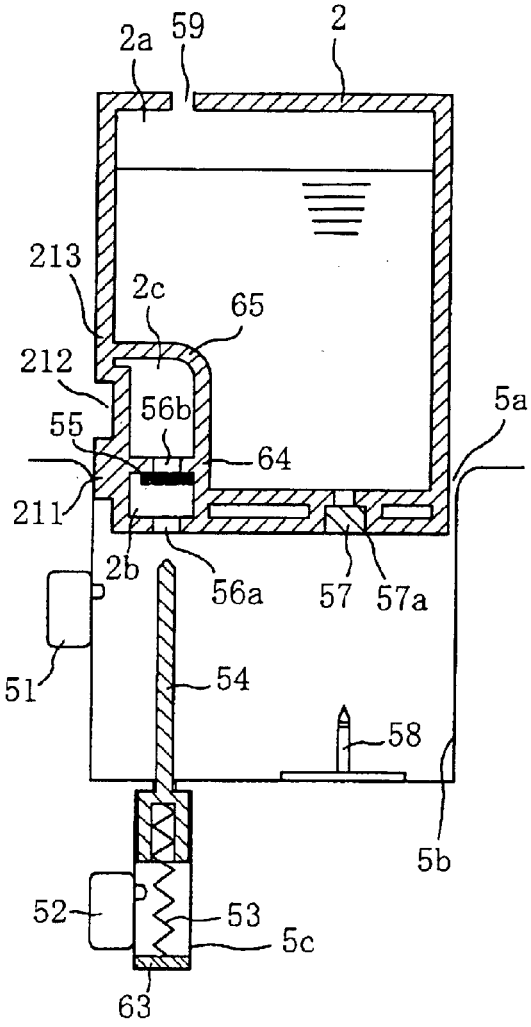
FIGS. 3A and 3B are elevational views in cross section showing an ink cartridge and a head unit of the printer.
Figure 3B:
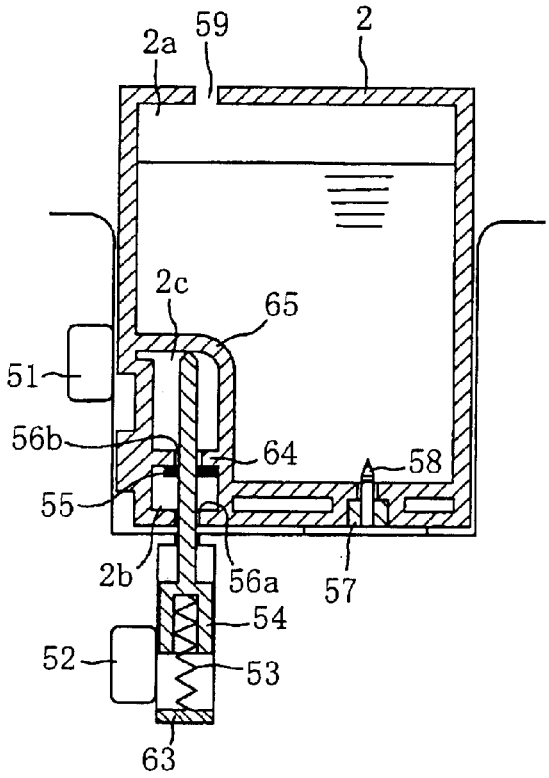

Referring next to the cross sectional views of FIGS. 3A and 3B, there will be described each ink cartridge 2 and the head unit 5. FIG. 3A shows the ink cartridge 2 before installation on the head unit 5, while FIG. 3B shows the ink cartridge 2 after installation on the head unit 5.

Each ink cartridge 2 has the above-indicated ink reservoir 2*a* for storing the ink, and two spaces or chambers in the form of a first passage 2*b* and a second passage 2*c* which are fluid-tightly isolated from the ink reservoir 2*a* and which are partially defined by an intermediate wall 64 formed therebetween. The ink reservoir 2*a* is partially defined by a bottom wall which has an ink outlet 57*a* formed therethrough. Before the ink cartridge 2 is installed on the head unit 5, this ink outlet 57*a* is closed by a plug 57 formed of an elastic material and press-fitted in the ink outlet 57*a*. The ink outlet 57*a* is provided for supplying the corresponding ink-jet head 4 with the ink. The ink reservoir 2*a* is also partially defined by a top wall having an atmosphere inlet 59 formed therethrough. This atmosphere inlet 59 is held in communication with the atmosphere so that the volume of the atmosphere within the ink reservoir 2*a* is increased as the volume of the ink in the ink reservoir 2*a* is consumed. The atmosphere inlet 59 is connected to an atmosphere inlet passage (not shown) which is provided with a suitable device such as an ink sump, a gas-liquid separating filter or a check valve for preventing a discharge flow of the ink out of the ink reservoir 2*a* or the atmosphere inlet passage. The first and second passages 2*b* and 2*c* are used for determining the state of the ink cartridge 2, as described below, so that these passages 2*b*, 2*c* are required to be formed at a portion of the ink cartridge 2 which is not accessible by the hands of the user or not recognizable by the user as the portion in which the passages 2*b*, 2*c* are formed therein. For this reason, the first and second passages 2*b*, 2*c* are formed within the housing of the ink cartridge 2. The intermediate wall 64 has a through-hole 56*b* open to the first and second passages 2*b*, 2*c*, and the first passage 2*b* is open to the atmosphere through an opening 56*a* formed through the bottom wall which has the ink outlet 57*a* described above. The opening 56*a* and the through-hole 56*b* are substantially aligned with each other, namely, have centers which lie on the same straight line extending in the longitudinal direction of the ink cartridge 2. The opening 56*a* and the ink outlet 57*a* both of which are formed through the above-indicated bottom wall are open outwardly of the ink cartridge 2, in the longitudinal direction of the ink cartridge 2. The second passage 2*c* is partially defined by an upper wall 65 which is formed inwardly of and generally in parallel with the intermediate wall 64. The intermediate wall 64 is provided with a non-reversibly changing member in the form of a film 55 affixed thereto so as to normally close the through-hole 56*b* and isolate the first and second passages 2*b*, 2*c* from each other. When the ink cartridge 2 is installed on the head unit 5 such that the lower portion of the ink cartridge 2 is received in a corresponding one of four recesses 5*b* formed in the head unit 5, the film 55 comes into abutting contact with the distal end of a projecting member in the form of a projecting rod 54 extending through the recess 5*b*, as described below in detail. As the ink cartridge 2 is further moved toward the bottom of the recess 5*b*, the projecting rod 54 is pushed by the film 55 and moved against a biasing force of a spring 53 which biases the projecting rod 54 in the direction of extension of the projecting rod 54 into the recess 5*b*. The film 55 has a mechanical strength enough to withstand the biasing force of the spring 53 and enough to be able to push the projecting rod 54 against the biasing force of the spring 53, without a rupture of the film 55. The projecting rod 54 is guided at its proximal end portion within a guide hole 5*c* partially defined by a stop member in the form of a bottom stop wall 63 such that the spring 53 interposed between the bottom stop wall 63 and the proximal end of the projecting rod 54 biases the rod 54 in the direction from the stop wall 63 toward the distal end of the rod 54. When the ink cartridge 2 is further moved toward the bottom of the recess 5*b* with a force larger than the biasing force of the spring 53 after the proximal end of the rod 54 has been brought into contact with the stop wall 63, the film 55 is pierced with the rod 54. The film 55 is referred to as the "non-reversibly changing member" in the sense that the film 55 once ruptured by the rod 54 is not able to push back the rod 54. The film 55 may be replaced by a member which is located between the first and second passages 2*b*, 2*c* and which is plastically deformable. All of the four ink cartridges 2 for the respective four colors have the same construction as described above.

As indicated above, the head unit 5 has the four recesses 5*b* which correspond to the respective four in-jet heads 4 and in which the respective four ink cartridges 2 are removably installed. Each of the recesses 5*b* has an upper open end 5*a* through which the lower portion of the ink cartridge 2 is moved into the recess 5*b*. As shown in FIG. 3A, the bottom of the recess 5*b* of the ink-jet head 4 is provided with an ink supply portion in the form of an ink outlet needle 58 which is located in alignment with the ink outlet 57*a* of the ink cartridge 2 when the ink cartridge 2 is installed. The bottom of the recess 5*b* is also provided with the above-indicated projecting rod 54 such that the rod 54 is aligned with the opening 56*a* of the first passage 2*b* when the ink cartridge 2 is installed. To install each ink cartridge 2 on the head unit 5, the lower portion of the ink cartridge 2 is moved into the recess 5*b* through the upper open end 5*a*, toward the bottom of the recess 5*b*, until the distal end of the projecting rod 54 is inserted into the second passage 2*c* through the opening 56*a*, first passage 2*b* and the film 55, while the distal end of the ink-outlet needle 58 is inserted into the ink reservoir 2*a* through the plug 57. Thus, the ink-jet head 2 is communicated at its ink supply portion 58 with the ink reservoir 2*a* of the ink cartridge 2. It is noted that the first and second passages 2*b*, 2*c* extend in the direction of movement of the ink cartridge 2 for installation thereof on the head unit 5.

The guide hole 5*c* indicated above is formed in the ink-jet head 4 so as to extend in the direction of movement of the ink cartridge 2 for installation thereof such that the guide hole 5*c* is open in the bottom surface of the recess 5*b*, so that the projecting rod 54 is guided and supported by the guide hole 5*c*, so as to extend into the recess 5*b* under the biasing action of the spring 53. The projecting rod 54 has a length larger than that of the guide hole 5*c*, so that the distal end portion of the rod 54 is located within the recess 5*b* even after the rod 54 has been retracted into abutting contact with the bottom stop wall 63 of the guide hole 5*c*.

Each ink-jet head 4 has a recess open in one side surface of the recess 5*b*. In this recess, there is fixedly received the above-indicated first sensor 51, which has an actuator member operated by the ink cartridge 2 during installation thereof. The ink-jet head 4 further has a recess open in the circumferential surface of the guide hole 5*c*. In this recess, there is fixedly received the above-indicated second sensor 52, which has an actuator member operated by the projecting rod 54 during its movement toward the bottom stop wall 63. Each of these first and second sensors 51, 52 is turned ON and OFF, namely, has a HIGH state or a LOW state, depending upon the present position of the actuator member. Described more specifically, the ink cartridge 2 has a first raised portion 211, a recessed portion 212 and a second raised portion 213, which are formed on the side surface of the ink cartridge 2 corresponding to the above-indicated side surface of the recess 5*b*. The raised, recessed and raised portions 211, 212, 213 are arranged in this order of description and spaced from each other, in the longitudinal direction of the ink cartridge 2 from the bottom wall to the top wall that is, in the direction of movement of the ink cartridge 2. The first sensor 51 is placed in the ON or HIGH state when the actuator member is pressed by the raised portion 211 or 213, and in the OFF or LOW state when the actuator member is received at its end portion in the recessed portion 212. The projecting rod 54, first and second sensors 51, 52, etc. which have been described are provided for each of the four ink cartridges 2.

Figure 4:
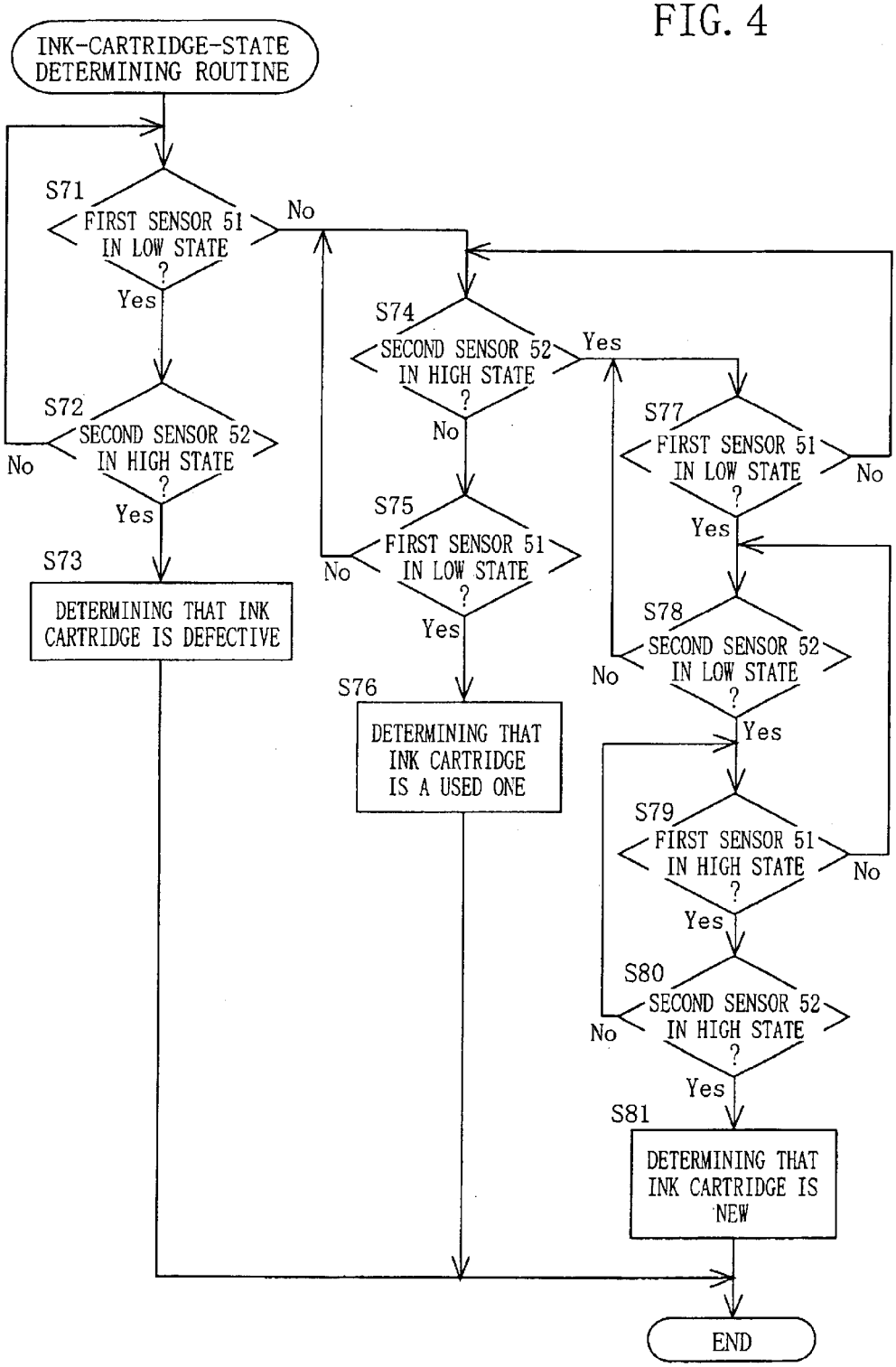
FIG. 4 is a flow chart illustrating a ink-cartridge-state determining routine executed by a main control board of the printer.
Figures 5A, 5B, 5C, 5D, 5E, 5F, 5G, 5H:
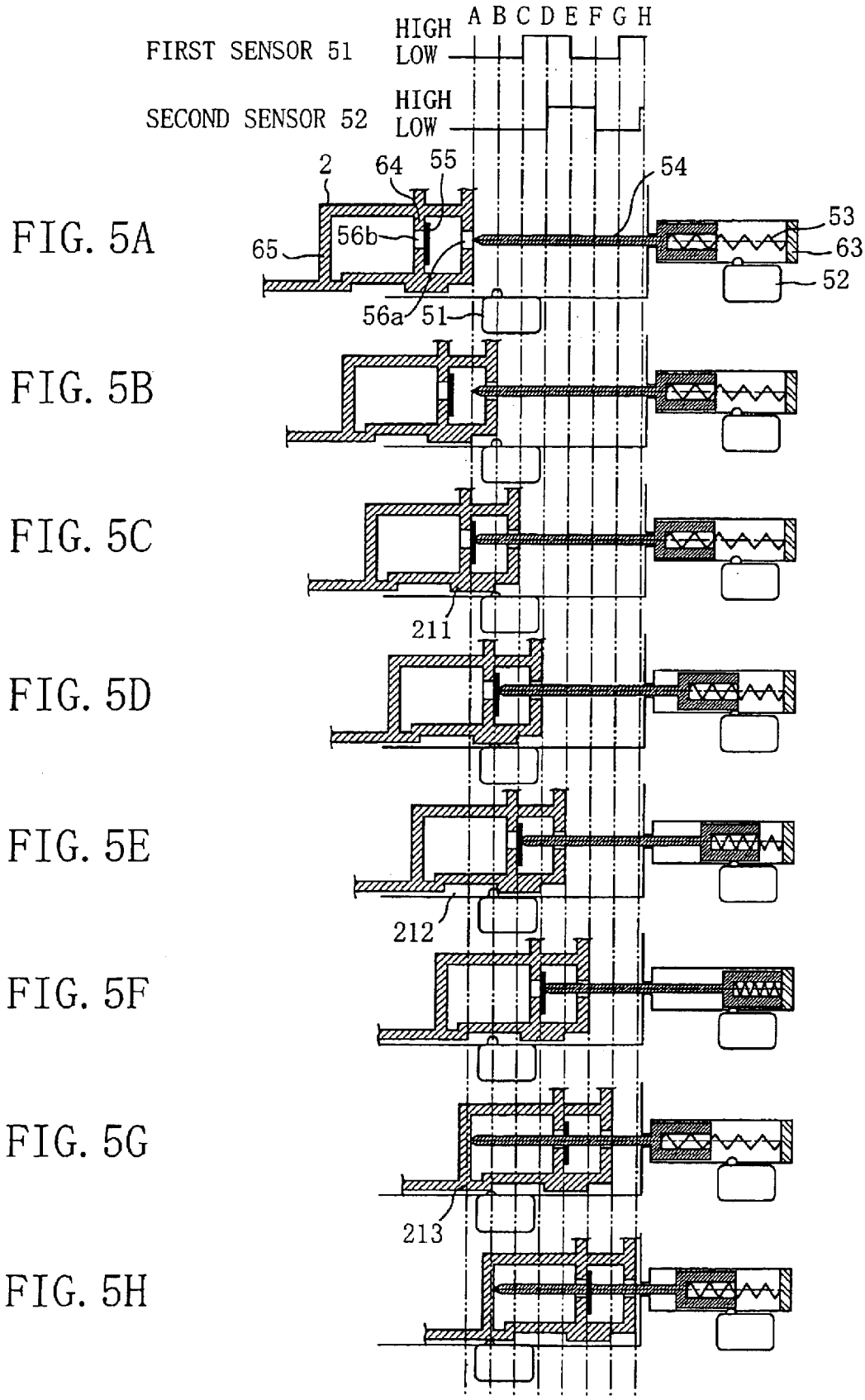
FIGS. 5A through 5H are views indicating changes in the state of a new ink cartridge when this ink cartridge is installed on the printer.

Reference is now made to the flow chart in FIG. 4 illustrating the ink-cartridge-state determining routine for determining the state of the ink cartridge 2, and the schematic cross sectional views of FIGS. 5A through 5H for explaining changes of the positions of the ink cartridge 2 and the projecting rod 4 from those of FIG. 3A to those of FIG. 3B, and changes of the states of the first and second sensors 51, 52.

Where the ink cartridge 2 to be installed is a new one wherein the non-ruptured film 55 closes the through-hole 56*b* and isolates the first and second passages 2*b*, 2*c* from each other, the first sensor 51 is spaced apart from the ink cartridge 2 prior to the installation of the ink cartridge 2 in the recess 5*b*, while the second sensor 52 is spaced apart from the projecting rod 54 held in its fully advanced position under the biasing force of the spring 53, as shown in FIG. 3A and as indicated in FIG. 5A. Accordingly, the first and second sensors 51, 52 are both placed in the OFF or LOW state. In this case, an affirmative decision (Yes) is obtained in step S71 while a negative decision (No) is obtained in step S72, in the routine of FIG. 4, so that steps S71 and S72 are repeatedly implemented.

To install the ink cartridge 2, a movement of the ink cartridge 2 into the recess 5*b* is initiated, so that the distal end portion of the projecting rod 54 is inserted into the first passage 2*b* through the opening 56*a*, as indicated in FIG. 5B. The first and second sensors 51, 52 are kept in the LOW state until the film 55 has reached the distal end of the projecting rod 54.

When the film 55 has reached the distal end of the rod 54 with a further movement of the ink cartridge 2 into the recess 5*b*, the first raised portion 211 provided on the side surface of the cartridge 2 comes into contact with the actuator member of the first sensor 51, as indicated in FIG. 5C, so that the first sensor 51 is brought into the HIGH state, and a negative decision (No) is obtained in steps S71, S74 and S75.

A further movement of the cartridge 2 causes the film 55 to push the projecting rod 54, without rupturing of the film 55, so that the actuator member of the second sensor 52 is operated by the proximal end of the rod 54, as indicated in FIG. 5D, whereby the second sensor 52 is brought into the HIGH state. As a result, an affirmative decision (Yes) is obtained in step S74. In this state, the first sensor 51 is still kept in its HIGH state, and a negative decision (No) is obtained in step S77.

A still further movement of the cartridge 2 causes the actuator member of the first sensor 51 to clear the first raised portion 211 and move into the recessed portion 212, as indicated in FIG. 5E, so that the first sensor 51 is brought into the LOW state, and an affirmative decision (Yes) is obtained in step S77. This movement of the cartridge 2 also causes a further movement of the projecting rod 54 toward the bottom stop wall 66 of the guide hole 5*c*, so that the second sensor 52 is kept in the HIGH state, and a negative decision (No) is obtained in step S78.

A yet further movement of the cartridge 2 causes the proximal end of the projecting rod 54 to come into abutting contact with the stop wall 63 of the guide hole 5*c*, while the first and second sensors 51, 52 are kept in the LOW and HIGH states, respectively, as indicated in FIG. 5F. In this condition, the cartridge 2 has not reached the bottom of the recess 5*b*. A further movement of the cartridge 2 toward the bottom of the recess 5*c* causes the film 55 to be pierced and ruptured by the distal end portion of the projecting rod 54.

As a result, the projecting rod 54 is advanced through the ruptured film 55 by the biasing force of the spring 53, so that the distal end portion of the rod 54 enters the second passage 2*c*, as indicated in FIG. 5G. Accordingly, the second sensor 52 is placed in the LOW state, and an affirmative decision (Yes) is obtained in step S78. As is apparent from the foregoing description, the film 55 is changeable from a first state for a first relationship with the rod 54, namely, a first state for inhibiting a relative movement of the cartridge 2 and the rod 54, to a second state for a second relationship with the rod 54, namely, a second state for permitting this relative movement, as the rod 54 is inserted into the passages 2*b*, 2*c*. However, the film 55 is not able to change from the second state back to the first state. A further movement of the cartridge 2 causes the second raised portion 213 to operate the actuator member of the first sensor 51, thereby bringing the first sensor 51 into the HIGH state, so that an affirmative decision (Yes) is obtained in step S79. At the same time, this movement of the cartridge 2 causes the projecting rod 54 to be retracted toward the bottom stop wall 63, with the distal end of the rod 54 held in abutting contact with the top wall 63.

When the cartridge 2 has reached the bottom of the recess 5*b*, the second sensor 52 is operated by the projecting rod 54 and brought into the HIGH state, while the first sensor 51 is held in the HIGH state, as indicated in FIG. 5H. Accordingly, an affirmative decision (Yes) is obtained in step S80. Thus, the main control board 30, which functions as a determining portion, determines in step S81 that the ink cartridge 2 thus installed on the head unit 5 is a new one, and permits a normal printing operation of the color ink-jet printer 1. When the cartridge 2 and the projecting rod 54 have a relative position as indicated in FIG. 5H, the plug 57 is pierced by the ink-outlet needle 58, as shown in FIG. 3B, so that the corresponding ink-jet head 2 can be supplied with the ink from the ink reservoir 2*a* of the cartridge 2.

Figures 6A, 6B, 6C, 6D, 6E, 6F, 6G, 6H:
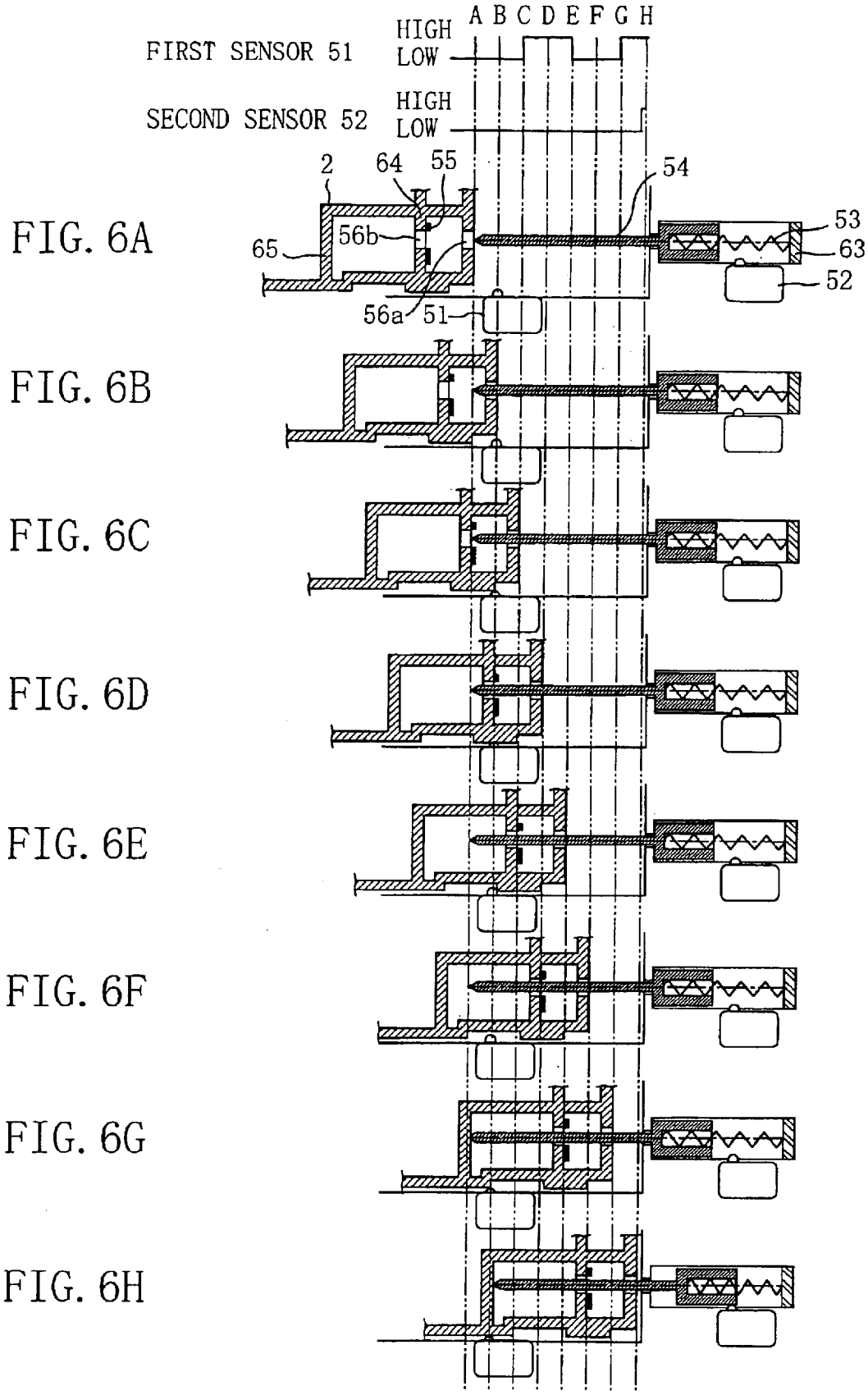
FIGS. 6A through 6H are views indicating changes in the state of a used ink cartridge when this ink cartridge is installed on the printer.

FIGS. 6A through 6H show a manner of installation of the ink cartridge 2 where the cartridge 2 is a used one, that is, where the cartridge 2 once installed on and removed from the head unit 5 is installed again. In this case, the phases indicated in FIGS. 6A, 6B and 6C are identical with those indicated in FIGS. 5A, 5B and 5C. Since the film 55 has already been ruptured, however, the movement of the cartridge 2 while the first sensor 51 is in the HIGH state does not cause the projecting rod 54 to be pushed by the film 55, as indicated in FIG. 6D, so that the first sensor 51 is brought into the LOW state, with the second sensor 52 kept in the LOW state, as indicated in FIG. 6E. Accordingly, a negative decision (No) is obtained in step S74, and an affirmative decision (Yes) is obtained in step S75, so that the determining portion in the form of the main control board 30 determines in step S76 that the ink cartridge 2 installed on the head unit 5 is a used one.

In the used ink cartridge 2, the ink may be almost entirely consumed, or may be deteriorated of its properties. Therefore, when it is determined in step S76 that the installed cartridge 2 is the used one, as described above, it is desirable to turn on the PRINTING INHIBIT flag 34*a*, command the operator's control panel 38 to provide an indication of an error, and inhibit the printing operation of the printer 1.

However, the printing operation of the printer 1 with the used ink cartridge 2 can be performed by adjusting the ink volume counter 35*a* such that the count of the ink volume counter 35*a* indicates the ink volume left in the ink cartridge 2 in question at the time when this cartridge 2 was removed from the printer 1 before it is installed again. In other words, the ink volume counter 35*a* is not reset to the initial value even when the installation of the used cartridge 2 is completed as indicated in FIG. 6H, but is adjusted to indicate the actual volume of the ink left in the used cartridge 2. In this respect, it is noted the ink volume counter 35*a* is reset to the initial value upon installation of the new ink cartridge 2 as indicated in FIG. 5H. Thus, the ink cartridge 2 which was once removed from the head unit 5 for inspection thereof or any other purpose and which is again installed on the head unit 5 can be used by setting the ink volume counter 35*a* so as to indicate the actual ink volume left in the ink reservoir 2*a* of the used cartridge 2.

Figures 7A, 7B, 7C, 7D, 7E, 7F, 7G, 7H:
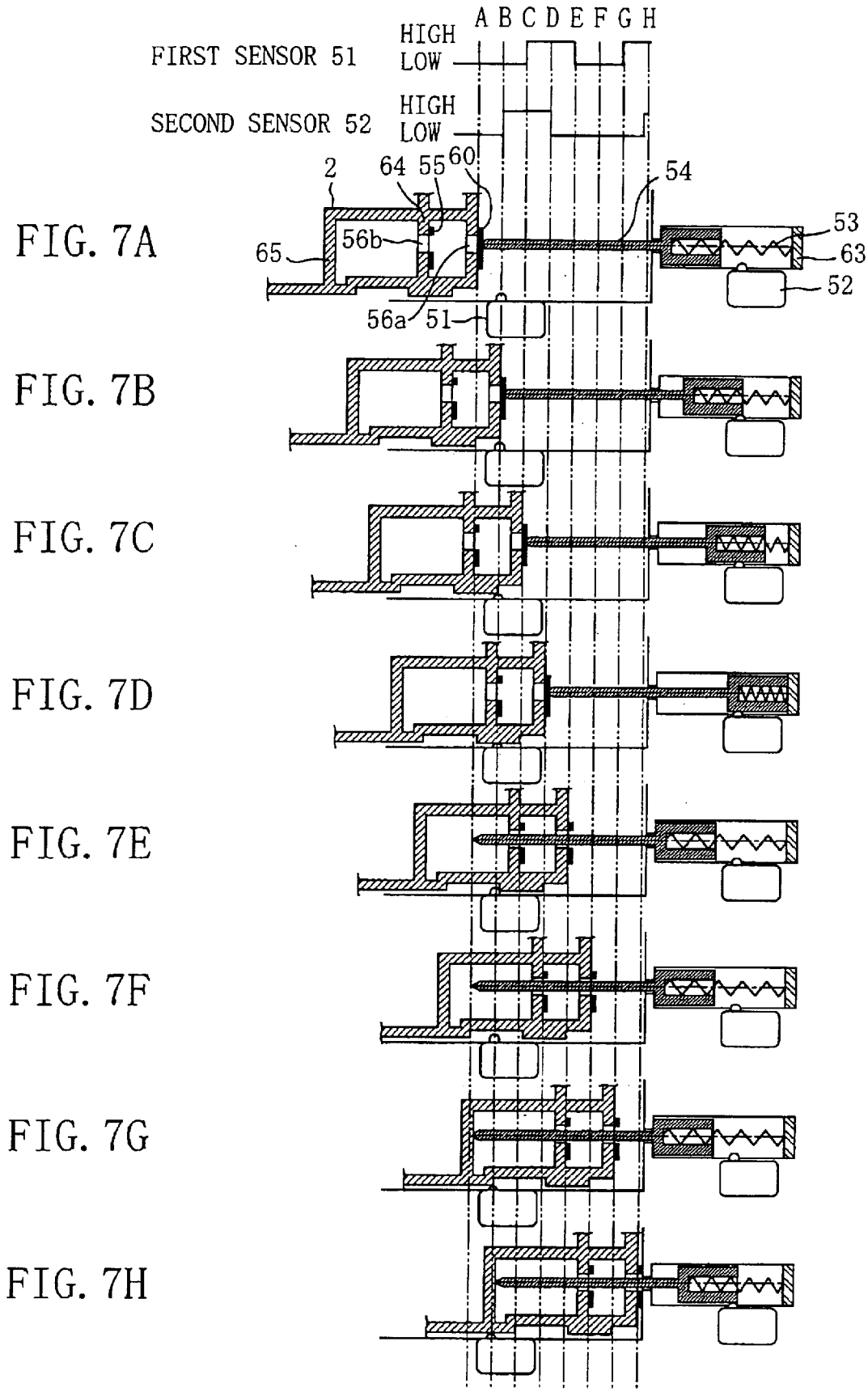
FIGS. 7A through 7H are views indicating changes in the state of a defective ink cartridge when this ink cartridge is installed on the printer.

FIG. 7 shows a manner of installation of the ink cartridge 2 where the cartridge 2 is defective, that is, where the opening 56 of the first passage 2*b* of the cartridge 2 is filled with a foreign matter, or closed by an adhesive tape or film 60, as indicated in FIG. 7A. Referring to FIGS. 7A through 7H, there will be described a manner of detecting the defective cartridge 2 with its opening 56*a* closed by the film 60.

The initial phase indicated in FIG. 7A is identical with that indicated in FIG. 5A. In the present case wherein the opening 56*a* is closed by the film 60, the film 60 pushes the projecting rod 54 so that the second sensor 52 is brought into the HIGH state, as indicated in FIG. 7B, before the first sensor 51 is brought into the HIGH state. That is, an affirmative decision (Yes) is obtained in step S72 of FIG. 4 before an affirmative decision (Yes) is obtained in step S71. Therefore, the main control board 30 functioning as the determining portion determines in step S73 that the installed cartridge 2 is defective or unacceptable with its opening 53*a* being closed by any matter (film 60). In this case, the PRINTING INHIBIT flag 34*a* is turned on to inhibit a printing operation of the printer 1, and the operator's control panel 38 is commanded to provide an indication of an error.

The closure of the opening 56*a* with a certain matter or member is detected to prevent a trouble in the printing operation using this cartridge 2. For instance, the non-used ink cartridge 2 may be delivered or shipped to the user, with its ink outlet 57*a*, atmosphere inlet 59 and opening 56*a* being closed by a stripe of the adhesive film 60 so as to secure fluid and air tightness of the ink reservoir 2*a*. In this instance, the user may install this ink cartridge 2 without removing the film 60, without recognizing the film 60, for example. In this event, the ink cannot be supplied from the cartridge 2 to the ink-jet head 2. To prevent this trouble, the error indication is given in step S73 to inform the operator of the error.

If the film 60 closing the opening 56*a* has a strength large enough to prevent its rupture by the projecting rod 54 even when a considerably large force is applied by the user to the cartridge 2 after the distal end of the rod 54 is brought into contact with the bottom stop wall 63, as indicated in FIG. 7D, the user can recognize that the force being applied to the cartridge 2 is excessively or abnormally large. Thus, the user can detect the abnormality associated with the cartridge 2 during installation thereof. If the film 60 has a strength that permits the film 60 to be ruptured by application of a suitable force to the cartridge 2 in the phase indicated in FIG. 7D, the installation of the cartridge 2 can proceed up to the phase indicated in FIG. 7H. However, the output signals of the sensors 51, 52 are ignored, on the basis of the determination in step S73, and the printing operation is inhibited.

In the color ink-jet printer 1 using the ink cartridges 2 according to the present embodiment described above, the state of the cartridge 2 can be accurately detected on the basis of the output signals of the first and second sensors 51, 52. That is, the head unit 5 and the ink cartridges 2 are constructed to permit accurate determination as to whether each cartridge 2 installed on the corresponding ink-jet head 4 is a new or used one, or defective or unacceptable for some reason or other.

It is noted that the film 55 affixed to the intermediate wall 64 within the housing of the cartridge 2 is not accessible by the user, who tries to re-affix or mend the film 55 through the opening 56*a*.

While one preferred embodiment of this invention has been described above, it is to be understood that the invention is not limited to the details of this illustrated embodiment, but may be embodied with various changes and improvements, which may occur to those skilled in the art, without departing from the spirit and scope of the present invention.

Although the atmosphere inlet 59 for introducing the atmosphere into the ink reservoir 2*a* is formed through the top wall of the ink cartridge 2 in the illustrated embodiment, the atmosphere may be introduced into the ink reservoir 2*a* through the opening 56*a*. Examples of this modification are shown in FIGS. 8 and 9.

Figure 8:
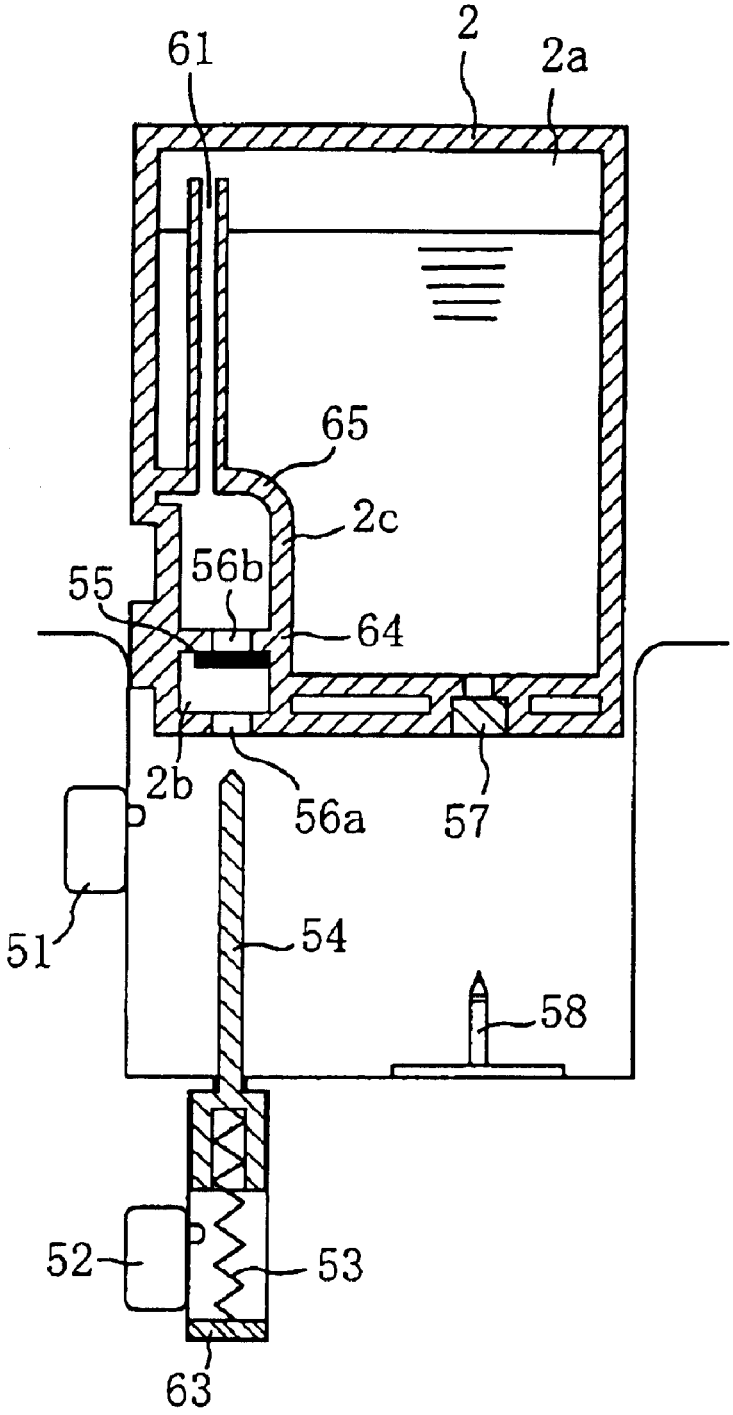
FIG. 8 is an elevational view in cross section showing an ink cartridge constructed according to a modified embodiment of this invention, wherein an opening 56*a* is utilized as an atmosphere inlet.

In the example shown in the cross sectional view of FIG. 8, the cartridge 2 has an atmosphere inlet passage 61 extending through the ink reservoir 2*a* in the longitudinal direction of the cartridge 2. The passage 61 has an upper end communicating with an upper portion of the ink reservoir 2*a* and a lower end portion formed through the upper wall 65 which partially defines the second passage 2*c*. Thus, the passage 61 is held in communication at its upper end with the reservoir 2*a* and at the lower end with the opening 56*a* through the first and second passages 2*b*, 2*c* and the through-hole 56*b*, when the cartridge 2 is installed in position. It is noted that the diameter of the rod 54 is smaller than the diameters of the opening 56*a* and through-hole 56*b*. The atmosphere is introduced into the upper atmosphere portion of the ink reservoir 2*a* through the atmosphere inlet passage 61, as the ink in the ink reservoir 2*a* is consumed.

In the ink cartridge 2 of FIG. 8, the ink reservoir 2*a* is brought into communication with the external space through the atmosphere inlet passage 61 when the film 55 is pierced by the projecting rod 54 which is provided to detect the state of the cartridge 2 when the cartridge 2 is installed on the head unit 5. In the first embodiment shown in FIGS. 3A and 3B, the atmosphere inlet 59 is closed when the cartridge 2 is shipped, and must be opened by the user prior to the installation. In the embodiment of FIG. 8, the user is not required to manually open the atmosphere inlet passage 61, since the passage 61 is automatically opened during installation of the cartridge 2.

Figure 9:
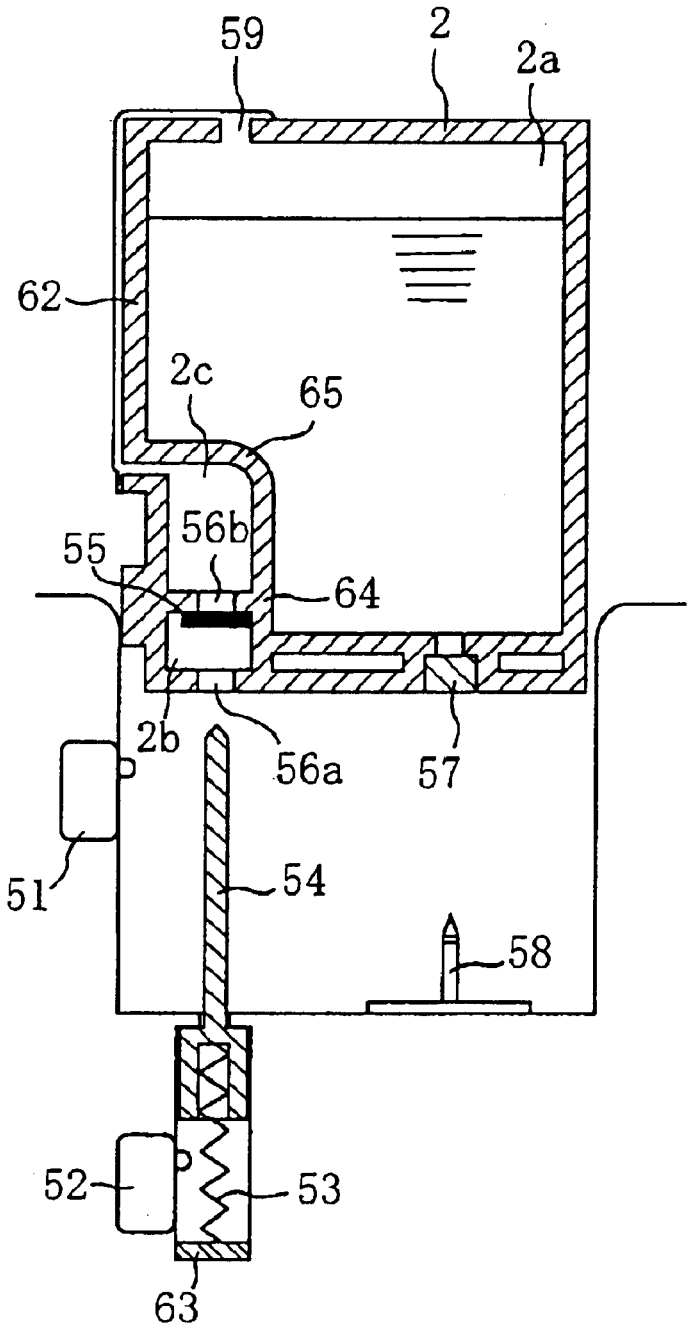
FIG. 9 is an elevational view in cross section showing an ink cartridge constructed according to a further modified embodiment of the invention, wherein the opening 56*a* is also utilized as the atmosphere inlet.

In another example shown in the cross sectional view of FIG. 9 wherein the atmosphere is introduced through the opening 56*a*, the ink cartridge 2 has an atmosphere inlet passage 62 which is held in communication at its upper end with the atmosphere inlet 59, which is formed through the top wall of the cartridge 2 as in the first embodiment. This atmosphere inlet passage 62 is defined by a groove formed in one side surface of the casing of the cartridge 2, and a gas-tight film which is bonded or otherwise affixed to the side surface, so as to gas-tightly close the opening of the groove. The thus formed atmosphere inlet passage 62 is held in communication at its lower end with an upper part of the second passage 2*c*.

In the ink cartridge 2 shown in FIG. 9, the ink reservoir 2*a* is brought into communication with the external space through the atmosphere inlet passage 62 when the film 55 is pierced by the projecting rod 54 which is provided to detect the state of the cartridge 2 when the cartridge 2 is installed on the head unit 5. In the embodiment of FIG. 9, the user is not required to manually open the atmosphere inlet passage 62, since the passage 62 is automatically opened during installation of the cartridge 2.

In the illustrated embodiments, the determination in step S81 that the installed cartridge 2 is a new one is made after the installation of the cartridge 2 is completed, that is, after the affirmative decision (Yes) is obtained in step S80 in the flow chart of FIG. 4. However, since the affirmative decision (Yes) in step S78 that the second sensor 52 is placed in the LOW state indicates that the cartridge 2 in the process of installation is a new one, the determination of the new cartridge 2 can be made immediately after the affirmative decision (Yes) in step S78.

While the illustrated embodiments are arranged to permit determination as to whether the installed cartridge 2 is a new or used one or defective, the illustrated embodiments may be modified to permit only the determination as to whether the installed cartridge 2 is a new or used one. This determination may depend upon whether the film 55 affixed to the intermediate wall 64 has been ruptured or not. The determination as to whether the film 55 has been ruptured or not may be made by simply determining whether the second sensor 52 is brought into the HIGH state or not (whether the affirmative decision is obtained in step S74) while the first sensor 52 is held in the HIGH state (while the negative decision is obtained in step S71) with its actuator member in contact with the first raised portion 211. Namely, the determination in question may be made depending upon whether the cartridge 2 and the projecting rod 54 are placed in the phase indicated in FIG. 5D or in the phase indicated in FIG. 6D.

While the illustrated embodiments are adapted to detect the state of the ink cartridge 2 storing an ink, the application of the present invention is not limited to the ink cartridge, but the principle of the invention is equally applicable to any cartridge such as a toner cartridge storing a toner.

In the illustrated embodiments, the ink cartridge 2 and the first sensor 51 are arranged such that the state or output of the first sensor 51 changes a plurality of times as the ink cartridge is moved toward the bottom of the recess 5*b*, for installation thereof on the ink-jet head 4, and the main control board 30 is arranged to determine the state of the ink cartridge on the basis of a plurality of combinations of the outputs of the first and second sensors 51, 52.

The illustrated embodiments are further arranged such that the main control board 30 determines the state of the film 55, namely, determines whether the film 55 has been ruptured or not, on the basis of the output of the first sensor 51 generated when the ink cartridge 2 is located at a predetermined position indicated in FIGS. 5D and 6D, during its movement for installation thereof, and the output of the second sensor 52 which is determined by a position of the projecting rod 54 relative to the ink jet head 4.

The illustrated embodiments are further arranged such that the main control board 30 determines that the ink cartridge 2 is defective or abnormal, on the basis of the output of the second sensor 52 generated when the second sensor is operated by the projecting rod 54, while the output of the first sensor 51 indicates that the film 55 has not reached the projecting rod 54. Where the insertion of the projecting rod 54 into the first passage 2*b* is prevented by the film 60 closing the opening 56*a*, for example, this abnormality of the cartridge 2 can be detected on the basis of the output of the second sensor 52 while the output of the first sensor 51 indicates that the film 55 has not been brought into abutting contact with the distal end of the rod 54.

In the illustrated embodiments, the main control board 30 is arranged to determine whether the film 55 has been ruptured or not by the projecting rod 54, on the basis of the output of the second sensor 52 generated when or after the film 55 has been brought into abutting contact with the projecting rod 54, after the output of the first sensor 51 has changed before film 55 reaches the projecting member 54 during the movement of the ink cartridge 2 for installation thereof on the ink jet head 4. This arrangement to detect the state of the film 55 permits accurate determination as to whether the installed cartridge 2 is a new one or a used one.

In the illustrated embodiments, the film 55 in the non-ruptured state is held in abutting contact with the projecting rod 54, so as to inhibit insertion of the distal end portion of the projecting rod 54 into the inner or second passage 2*c* located inwardly of the film 55 within the ink cartridge 2, when a first force acts on the ink cartridge 2 in the direction of movement thereof for installation thereof on the ink-jet head 4. The film 55 in abutting contact with the projecting rod 54 permits the projecting rod 54 to be moved with the ink cartridge in the direction of movement toward the ink-jet head 4. The film 55 is ruptured or pierced by the projecting rod 54, when a second force larger than the first force acts between the projecting rod 54 and the film 55. The ruptured film 54 permits the insertion of the distal end portion of the projecting rod 54 into the second passage 2*c*. Once the film 55 is ruptured by the projecting rod 54, the film 55 is not able to inhibit the insertion of the distal end portion of the projecting rod 54 into the second passage 2*c*. This arrangement permits accurate determination as to whether the ink cartridge 2 is a new or used one. In this respect, it is noted that the used ink cartridge 2 has the ruptured film 55.

The cartridge detecting device in each of the illustrated embodiments includes the bottom stop wall 63 for stopping a movement of the projecting rod 54 together with the ink cartridge 2 in the direction of movement of the ink cartridge 2 while the film 55 is held in abutting contact with the non-ruptured projecting rod 54. This stop wall 63 is provided to stop the movement of the projecting rod 54 before the ink cartridge 2 has been installed at a predetermined position of installation on the ink-jet head 4. The film 55 is ruptured when the ink cartridge 2 is further moved in the direction of movement for installation from a position at which the movement of the projecting rod 54 is stopped by the stop wall 63. This arrangement assures high stability of rupturing of the film 55 by the projecting rod 54 when the ink cartridge 2 has been moved to a predetermined position during the movement to the predetermined position of installation on the ink-jet head 4.

In the modified embodiments of FIGS. 8 and 9, the opening 56*a* of the ink cartridge 2 is communicated with an upper part of the ink reservoir 2*a*, for introducing the atmosphere into the upper part of the ink reservoir 2*a*, when the film 55 is ruptured by the projecting rod 64.

In each of the ink cartridges 2 constructed according to the illustrated embodiments, the first and second passages 2*b*, 2*c* cooperate to form a passage extending in a direction of movement of the ink cartridge 2 for installation thereof on the corresponding ink-jet head 4. This passage 2*a*, 2*b* has the opening 56*a* open at one end of the ink cartridge in the direction of movement. The ink cartridge 2 includes a non-reversibly changing member in the form of the film 55 disposed in the passage 2*b*, 2*c*, at a predetermined distance from the opening 56*a*. The film 55 is changeable from a first state for inhibiting a relative movement of the ink cartridge 2 and a projecting member in the form of the projecting rod 54, to a second state for permitting the relative movement, as the projecting rod 54 is inserted into the passage 2*b*, 2*c*. Namely, the film 55 is ruptured during the movement of the ink cartridge 2 or during the insertion of the projecting rod 54 into the second passage 2*c*. The film 55 once ruptured is not able to push back the projecting rod 54. In the present ink cartridge 2, whether the ink cartridge 2 is a new one or a used one can be accurately determined depending upon whether the film 55 has been ruptured or not. In addition, the film 55 is not accessible by the user of the ink cartridge 2 or the printer 1.

In the ink cartridge 2 in the illustrated modified embodiments of FIGS. 8 and 9, the opening 56*a* is communicated with an upper part of the ink reservoir 2*a*, for introducing the atmosphere into the upper part when the film 55 is ruptured by the projecting rod 54.

What is claimed is:

1. A cartridge detecting device for detecting a state of a cartridge to be removably installed on a working device, said cartridge detecting device comprising:

a passage formed within said cartridge and extending in a direction of movement of said cartridge for installation thereof on said working device, said passage having an opening open at one end of said cartridge in said direction of movement;

a projecting member insertable into said passage through said opening as said cartridge is moved for installation thereof on said working device, said projecting member being movable in said direction of movement;

a non-reversibly changing member disposed in said passage, at a predetermined distance from said opening, said non-reversibly changing member being changeable from a first state for a first relationship with said projecting member, to a second state for a second relationship with said projecting member, said non-reversibly changing member being unable to change from said second state back to said first state;

a first detector operable by said cartridge when said cartridge is moved for installation thereof on said working device;

a second detector operable by said projecting member during the movement of said cartridge for installation thereof on said working device; and a determining portion connected to said first and second detectors and determining the state of said cartridge on the basis of outputs of said first and second detectors.

2. The cartridge detecting device according to claim 1, wherein said non-reversibly changing member inhibits a relative movement of said cartridge and said projecting member when said non-reversibly changing member is placed in said first state, and permits said relative movement when said non-reversibly changing member is placed in said second state.

3. The cartridge detecting device according to claim 2, wherein said non-reversibly changing member comprises a generally planar member which inhibits insertion of a distal end portion of said projecting member into an inner portion of said passage located inwardly of said non-reversibly changing member within said cartridge, when said generally planar member is placed in said first state, and which permits the insertion of said distal end portion of said projecting member into said inner portion of said passage, when said generally planar member is placed in said second state.

4. The cartridge detecting device according to claim 1, wherein said cartridge and said first detector are arranged such that the output of said first detector changes a plurality of times as said cartridge is moved for installation thereof on said working device, and said determining portion is operable to determine the state of said cartridge on the basis of a plurality of combinations of the outputs of said first and second detectors.

5. The cartridge detecting device according to claim 4, wherein said determining portion is operable to determine a state of said non-reversibly changing member on the basis of the output of said first detector generated when said cartridge is located at a predetermined position relative to said working device during said movement for installation thereof, and the output of said second detector which is generated in response to a position of said projecting member relative to said second detector.

6. The cartridge detecting device according to claim 1, wherein first detector is fixed to said working device, and said cartridge has a plurality of portions which are spaced from each other in said direction of movement and which are positioned relative to said first detector, so as to be engageable with said first detector during the movement thereof in said direction of movement, for thereby changing the output of said first detector.

7. The cartridge detecting device according to claim 1, wherein said determining portion is operable to determine that said cartridge is abnormal, on the basis of the output of said second detector generated when said second detector is operated by said projecting member, while the output of said first detector indicates that said non-reversibly changing member has not reached said projecting member.

8. The cartridge detecting device according to claim 1, wherein said determining portion is operable, after the output of said first detector has changed before said non-reversibly changing member reaches said projecting member during said movement of said cartridge for installation thereof on said working device, to determine whether said non-reversibly changing member is placed in said first state or said second state, on the basis of the output of said second detector generated when or after said non-reversibly changing member has reached said projecting member.

9. The cartridge detecting device according to claim 1, wherein said first detector is fixed to said working device, and said cartridge has a portion positioned relative to said first detector, so as to be engageable with said first detector during the movement thereof in said direction of movement, for thereby changing the output of said first detector, before said non-reversibly changing member reaches said projecting member, and wherein said second detector is fixed to said working device, and said projecting member is movable by said non-reversibly changing member, after said non-reversibly changing member has reached said projecting member, for thereby changing the output of said second detector.

10. The cartridge detecting device according to claim 1, further comprising a stop member for stopping a movement of said projecting member together with said cartridge in said direction of movement of the cartridge while said non-reversibly changing member is held in engagement with said projecting member in said first state of said non-reversibly changing member, said stop member stopping said movement of said projecting member before said cartridge has been installed at a predetermined position of installation on said working device, said non-reversibly changing member changing from said first state to said second state when said cartridge is further moved in said direction of movement for installation thereof from a position at which said movement of the projecting member is stopped by said stop member.

11. The cartridge detecting device according to claim 1, wherein said cartridge is an ink cartridge having an ink reservoir, and said opening is communicated with an upper part of said ink reservoir, for introducing an atmosphere into said upper part when said non-reversibly changing member changes from said first state to said second state.

12. A cartridge detecting device for detecting a state of a cartridge to be removably installed on a working device, said cartridge detecting device comprising:

a passage formed within said cartridge and extending in a direction of movement of said cartridge for installation thereof on said working device, said passage having an opening open at one end of said cartridge in said direction of movement;

a projecting member insertable into said passage through said opening as said cartridge is moved for installation thereof on said working device, said projecting member being movable in said direction of movement;

a non-reversibly changing member disposed in said passage, at a predetermined distance from said opening, said non-reversibly changing member being changeable from a first state to a second state, said non-reversibly changing member being unable to change from said second state back to said first state;

a detector device operable depending upon whether said non-reversibly changing member is placed in said first state or said second state, when said cartridge is moved for installation thereof on said working device; and a determining portion operable to determine the state of said cartridge on the basis of an output of said detector device.

13. The cartridge detecting device according to claim 1, wherein said non-reversibly changing member is placed in said first state when a first force acts on said cartridge in said direction of movement thereof for installation thereof on said working device, said non-reversibly changing member in said first state engaging said projecting member so as to inhibit insertion of a distal end portion of said projecting member into an inner portion of said passage located inwardly of said non-reversibly changing member within said cartridge, and permitting said projecting member to be moved with said cartridge in said direction of movement, said non-reversibly changing member changing from said first state to said second state when a second force larger than said first force acts between said projecting member and said non-reversibly changing member, said non-reversibly changing member in said second state permitting the insertion of said distal end portion of said projecting member into said inner portion of said passage.

14. The cartridge detecting device according to claim 12, wherein said non-reversibly changing member is placed in said first state when a first force acts on said cartridge in said direction of movement thereof for installation thereof on said working device, said non-reversibly changing member in said first state engaging said projecting member so as to inhibit insertion of a distal end portion of said projecting member into an inner portion of said passage located inwardly of said non-reversibly changing member within said cartridge, and permitting said projecting member to be moved with said cartridge in said direction of movement, said non-reversibly changing member changing from said first state to said second state when a second force larger than said first force acts between said projecting member and said non-reversibly changing member, said non-reversibly changing member in said second state permitting the insertion of said distal end portion of said projecting member into said inner portion of said passage.

15. The cartridge detecting device according to claim 14, further comprising a stop member for stopping a movement of said projecting member together with said cartridge in said direction of movement of the cartridge while said non-reversibly changing member is held in engagement with said projecting member in said first state of said non-reversibly changing member, said stop member stopping said movement of said projecting member before said cartridges has been installed at a predetermined position of installation on said working device, said non-reversibly changing member changing from said first state to said second state when said cartridge is further moved in said direction of movement for installation thereof from a position at which said movement of the projecting member is stopped by said stop member.

16. The cartridge detecting device according to claim 12, wherein said cartridge is an ink cartridge having an ink reservoir, and said opening is communicated with an upper part of said ink reservoir, for introducing an atmosphere into said upper part when said non-reversibly changing member changes from said first state to said second state.

17. A cartridge to be removably installed on a working device, said cartridge comprising:

a passage formed extending in a direction of movement of said cartridge for installation thereof on said working device, said passage having an opening which is open at one end of said cartridge in said direction of movement and through which a projecting member is insertable as said cartridge is moved in said direction of movement for installation thereof on said working device; and a non-reversibly changing member disposed in said passage, at a predetermined distance from said opening, said non-reversibly changing member being changeable from a first state for a first relationship with said projecting member, to a second state for a second relationship with said projecting member, said non-reversibly changing member being unable to change from said second state back to said first state.

18. The cartridge according to claim 17, which is an ink cartridge having an ink reservoir, and wherein said opening is communicated with an upper part of said ink reservoir, for introducing an atmosphere into said upper part when said non-reversibly changing member changes from said first state to said second state.

19. The cartridge according to claim 17, wherein said non-reversibly changing member inhibits a relative movement of said cartridge and said projecting member when said non-reversibly changing member is placed in said first state, and permits said relative movement when said non-reversibly changing member is placed in said second state.

20. The cartridge according to claim 19, wherein said non-reversibly changing member comprises a generally planar member which inhibits insertion of a distal end portion of said projecting member into an inner portion of said passage located inwardly of said non-reversibly changing member within said cartridge, when said generally planar member is placed in said first state, and which permits the insertion of said distal end portion of said projecting member into said inner portion of said passage, when said generally planar member is placed in said second state.

21. The cartridge according to claim 17, wherein said cartridge has a plurality of portions which are spaced from each other in said direction of movement and which are positioned relative to a first detector fixed to said working device, so as to be engageable with said first detector during the movement thereof in said direction of movement, for thereby changing an output of said first detector.

22. The cartridge according to claim 17, wherein said cartridge has a portion positioned relative to a first detector provided on said working device, so as to be engageable with said first detector during the movement thereof in said direction of movement, for thereby changing an output of said first detector, before said non-reversibly changing member reaches said projecting member, and said projecting member is movable by said non-reversibly changing member, after said non-reversibly changing member has reached said projecting member, for thereby changing an output of a second detector provided on said working device.

23. The cartridge according to claim 17, wherein said non-reversibly changing member is placed in said first state when a first force acts on said cartridge in said direction of movement thereof for installation thereof on said working device, said non-reversibly changing member in said first state engaging said projecting member so as to inhibit insertion of a distal end portion of said projecting member into an inner portion of said passage located inwardly of said non-reversibly changing member within said cartridge, and permitting said projecting member to be moved together with said cartridge in said direction of movement, said non-reversibly changing member changing from said first state to said second state when a second force larger than said first force acts between said projecting member and said non-reversibly changing member, said non-reversibly changing member in said second state permitting the insertion of said distal end portion of said projecting member into said inner portion of said passage.

24. The cartridge according to claim 17, which is an ink cartridge having an ink reservoir, and said opening is communicated with an upper part of said ink reservoir, for introducing an atmosphere into said upper part when said non-reversibly changing member changes from said first state to said second state.

* * * * *